United States Patent [19]

Rogers

[11] 4,276,580

[45] Jun. 30, 1981

[54] PRESSURE ACTUATED ELECTRICAL SYSTEM

[75] Inventor: Charles J. Rogers, Charleston, S.C.

[73] Assignee: C. J. Rogers Enterprises Inc., Charleston, S.C.

[21] Appl. No.: 28,172

[22] Filed: Apr. 9, 1979

[51] Int. Cl.[3] ..... F21V 25/00

[52] U.S. Cl. ..... 362/22; 362/267; 362/276; 362/375; 362/390

[58] Field of Search ..... 362/22, 267, 276, 375, 362/390

[56] References Cited

U.S. PATENT DOCUMENTS 459,872 9/1891 Tommasi ..... 362/22

*Primary Examiner*—Stephen J. Lechert, Jr.

[57] ABSTRACT

This invention is an improvement to safe electrical systems which have a hermetically enclosed space containing an electrical circuit member wherein means are provided for connecting and disconnecting the electrical circuit member to a power source in response to pressure changes within the hermetically enclosed space and for altering the volume within the hermetically enclosed space to effect a pressure change therein.

9 Claims, 5 Drawing Figures

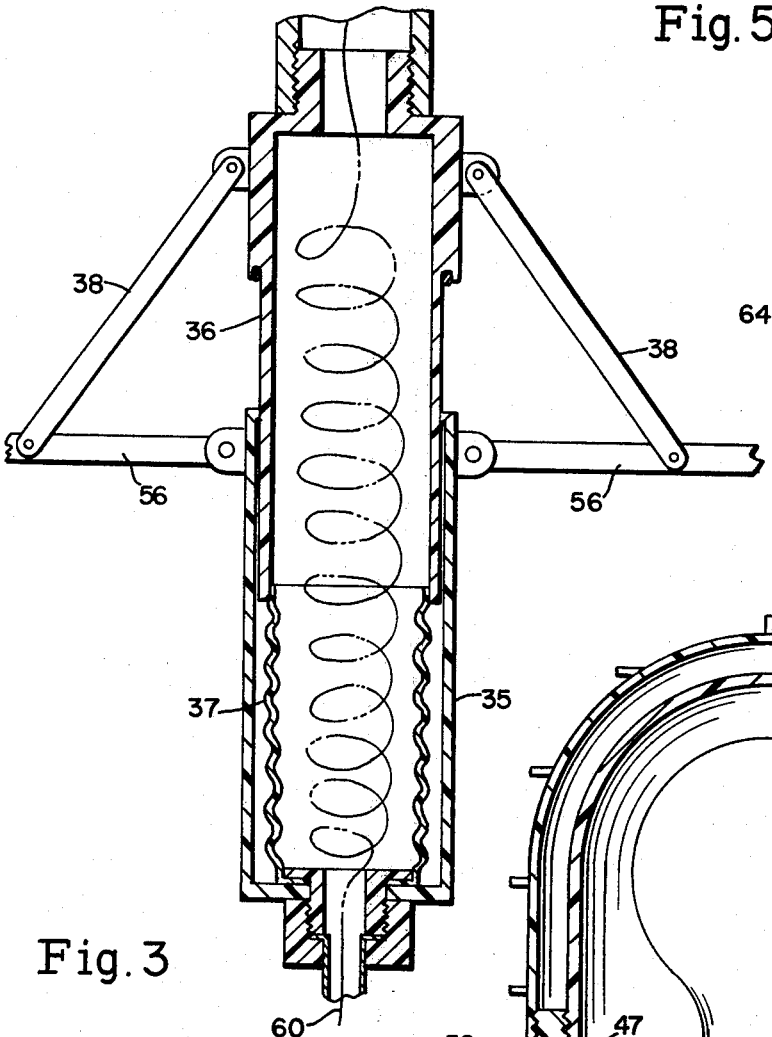
Fig. 3
Fig. 5
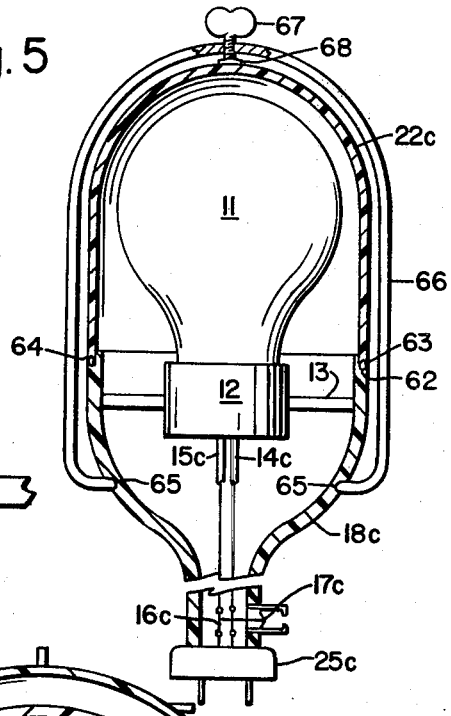
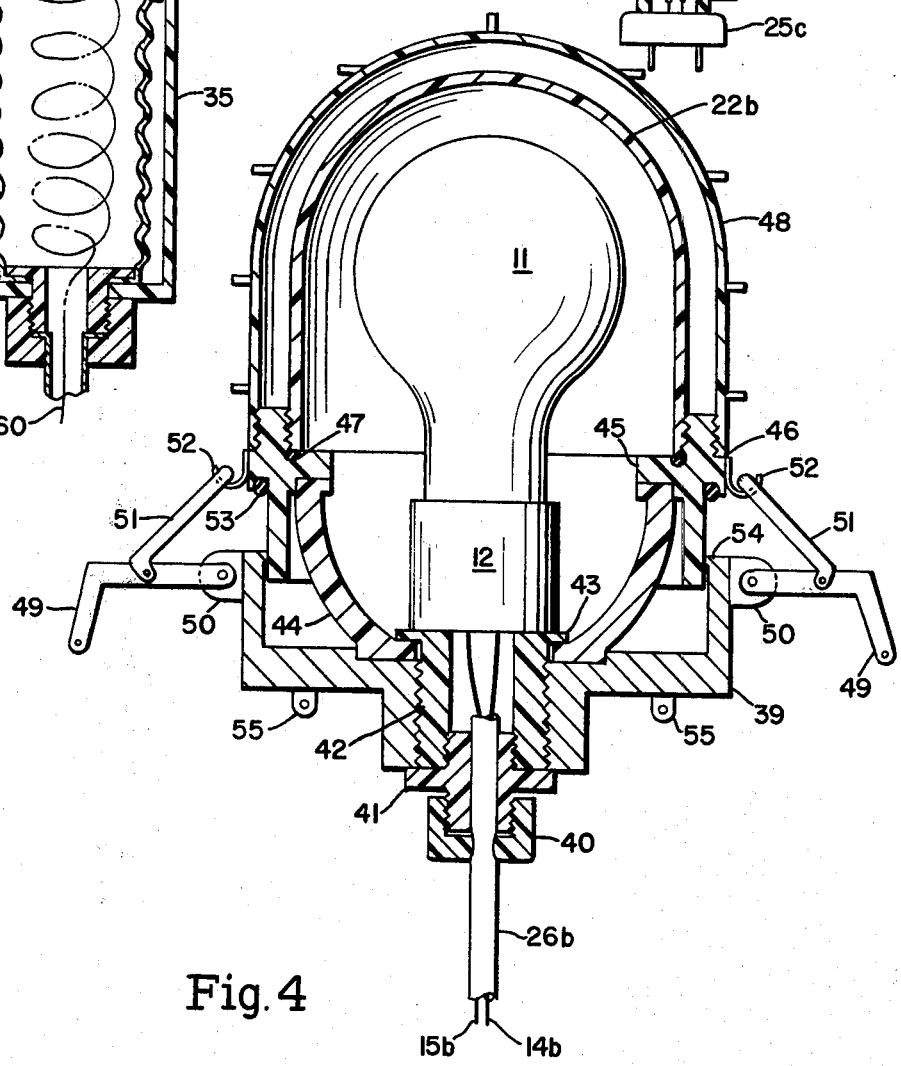
Fig. 4

PRESSURE ACTUATED ELECTRICAL SYSTEM

SUMMARY OF THE INVENTION

It has long been recognized that an electrical system can be made safe against shock and spark hazards by enclosing the electrical circuit within a hermetic enclosure, pressurizing the fluid within the enclosure and immediately disconnecting the power to the electrical circuit when a leak in the enclosure occurs and the pressure drops. As indicated by such U.S. Pats. as Nos. 1,266,779; 1,695,794; 2,304,085; 2,467,181 and 2,517,478, the potential of such systems to provide safe electrical systems for use in hazardous areas has been recognized since 1918.

Such systems provide a maximum of safety as it is virtually impossible for an individual to make contact with a current carrying element within the hermetic enclosure or for a spark to escape through the enclosure without the pressurized fluid within the enclosure leaking out thereby causing a drop in pressure and the shutting off of the power.

The primary difficulty with such systems which has limited their use lies in their need for an external source of fluid under pressure to pressurize the space within the hermetic enclosure. If the pressure supply is built into the system, it adds greatly to the cost and reduces mobility of the equipment. If the supply is separate, maintenance is made inconvenient due to the necessity of having the pressure supply and its connectors on hand to perform even the simplest repair work, such as, changing a light bulb.

Additionally, it has generally been felt that an appreciable pressure, in the pounds per square inch range, is required for the operation of such systems. This has led to a secondary hazard, that of explosion, when the enclosure is broken.

It is, therefore, the primary object of this invention to provide a safe electrical system of the type described that is self contained and which requires no external source of pressure.

It is a secondary object to provide such a system which can be operated at sufficiently low pressure as to eliminate any explosion hazard.

Another object is to provide a system which is adaptable for use at pressures higher or lower than the pressure of the surrounding atmosphere.

Other objects will become evident from the following disclosure.

The invention may be best understood by referring to the drawings wherein.

Figure 2:
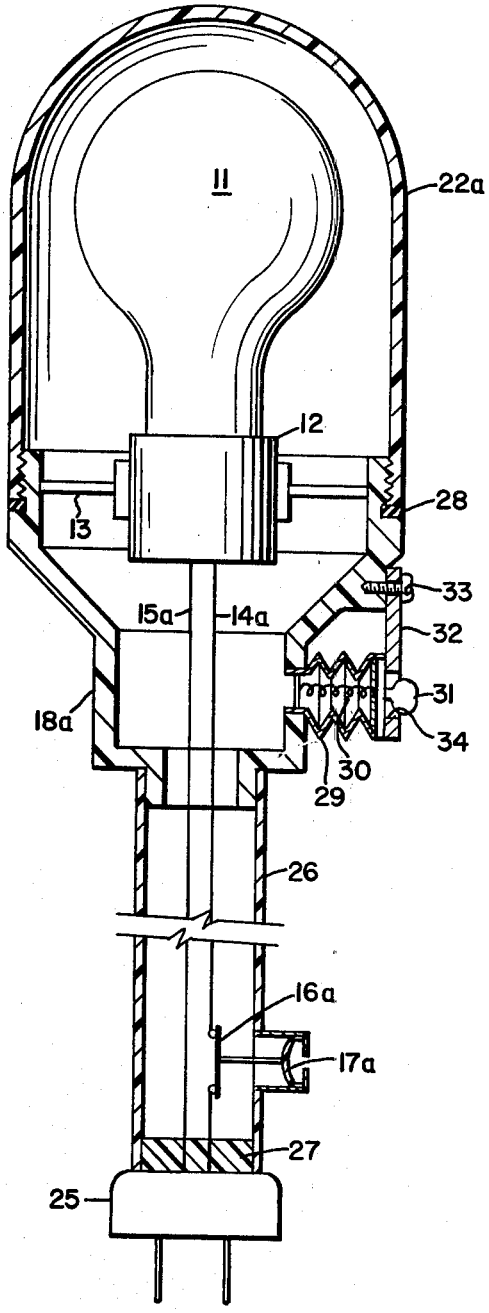
FIG. 2 represents a central cross section, with certain parts in elevation, of a second embodiment of this invention.
Figure 2A:
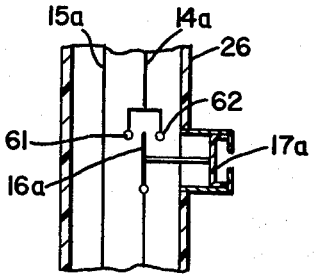

FIG. 2*a* is a central cross section of a modified diaphragm and switch for the embodiment of FIG. 2.

FIG. 3 represents a central cross section of a form of a pressurizing device for use in this invention.

FIG. 4 is a central cross section, with certain parts in elevation, of a third form of this invention.

FIG. 5, is a central cross section, with certain parts in elevation, of a preferred form of this invention.

DETAILED DESCRIPTION OF THE INVENTION

The drawings illustrate the use of the present invention wherein the electrical circuit member is a light bulb and its connecting wires. It is to be understood that the electrical circuit could be any electrical device through which current flows or across which an electrical potential exists and for which protection is desired. Such electrical circuits could range from a single conductor to a complex computer.

Figure 1:
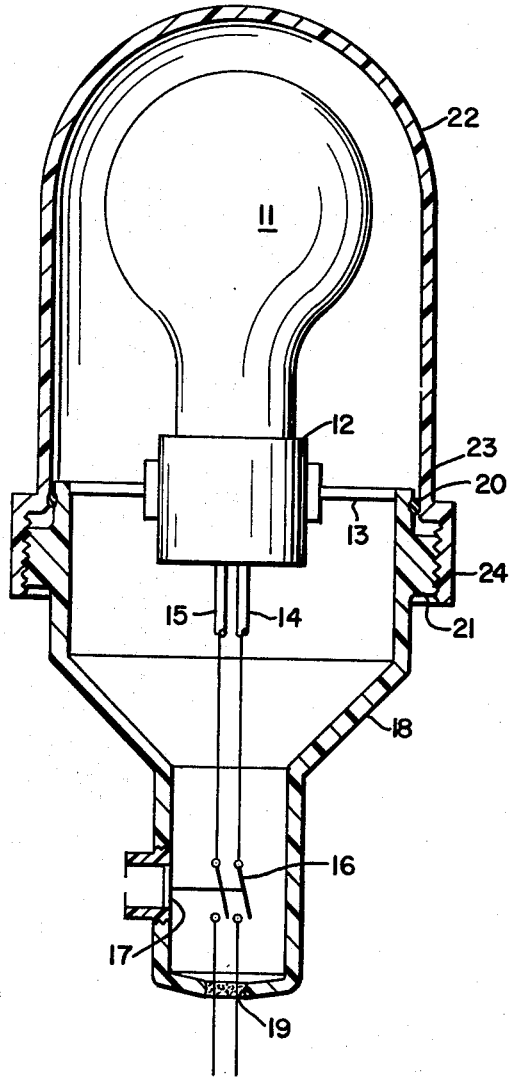
FIG. 1 represents a central cross section, with certain parts in elevation, of one embodiment of the invention.

Referring to the embodiment of FIG. 1, the light bulb 11 is electrically connected and physically supported by a standard socket 12. The socket is held in place by struts 13 through which air is free to pass.

Electrical current is supplied to the socket by wires 14, 15 which are connected to an appropriate power source. The wires are connected through a switch 16 which is biased in the open position as shown and is actuated by the outward flexing of diaphragm 17. The diaphragm is mounted in a casing 18 through which the wires pass at seal 19. The casing is equipped with an O-ring 20 and a threaded boss 21.

The globe 22 which encloses the light bulb has a generally cylindrical section 23 in close proximity to the internally threaded flange 24, the inside diameter of the threads of which is greater than the outside diameter of the O-ring so as to permit easy passage of the threaded flange over the O-ring.

It will readily be seen that if the casing and globe are separated each will be filled with air at ambient atmospheric pressure. As the globe is placed over the globe and screwed down the pressure within the casing and globe will remain at atmospheric pressure until the O-ring engages the inner wall of the cylindrical section of the globe. At this point the O-ring provides a seal between the globe and casing and air can no longer pass to or from the space enclosed by the casing and globe to the surrounding atmosphere. Further screwing of the globe onto the casing will diminish the volume of the enclosed space resulting in an increase in the pressure therein. This increased pressure applied to the diaphragm will cause it to flex outwardly closing switch 16 supplying power to the light.

If any part of the enclosure should subsequently be ruptured so as to permit a potentially hazardous condition to occur, the pressurized air within the enclosure will escape, the diaphragm no longer being flexed by the pressure will return to its normal position and the power will be cut off.

It should be noted that for a good workable system, it is necessary to correlate the reduction in space within the enclosure and the effective area of the diaphragm with the force required to close the switch. The increase in pressure within the enclosed space times the effective area of the diaphragm should be slightly greater than the force necessary to close the switch.

The embodiment of FIG. 2 is similar to that of FIG. 1 in that light 11 is held by socket 12 supported by struts 13 and is supplied with electrical current by wires 14*a*, 15*a* and is enclosed by casing 18*a* and globe 22*a*. It differs, however, in that switch 16*a*, controls only wire 14*a*, which is the "hot" line, and is located adjacent to plug 25 through which power for the circuit is obtained. As a consequence wires 14*a*, 15*a* are protected along their entire length. This is accomplished by extending the hermetically enclosed space within a flexible conduit 26 to seal 27 where the wires go to the plug. In this embodiment, the seal between the casing and globe is simplified with these parts having mating threads and the seal being formed by gasket 28.

This embodiment also differs in that it may be operated at a pressure lower than atmospheric, i.e., at a partial vacuum. This reduced pressure is created by bellows 29 equipped with a light spring 30 which normally keeps the bellows in a collapsed condition. After assembly of the globe onto the casing and their sealing together by the gasket, the bellows, which has been in a collapsed state during this operation, is extended to the position shown by pulling outward on knob 31. The bellows is locked in the extended position by swinging arm 32 around pivot screw 33 until slot 34 engages the knob.

The extension of the bellows increases the volume of the hermetically enclosed space thereby reducing the pressure therein. The reduced pressure flexes the diaphragm into the enclosed space closing the switch, as shown in the drawing.

It should be noted that in any decreased pressure system that the increase in volume must be made sufficiently large to cause a pressure decrease greater than the increase in pressure which may occur due to heating of the air in the enclosed space by the electrical circuit.

The use of the reduced pressure system is particularly recommended where a part of the electrical circuit may be located in an area where the pressure is higher than atmospheric and the diaphragm is in contact with ambient air at atmospheric pressure. A typical example of this would be underwater lights. In this situation, should a break in the globe or casing occur the water pressure might keep the pressure in the enclosed space high enough in an increased pressure system to prevent the switch from opening the circuit. Under the same conditions the switch would be readily activated in a reduced pressure system.

It will be recognized that the embodiment of FIG. 2 can be easily adapted for use in both increased pressure systems and decreased pressure systems by modifying the bellows and switch arrangement as shown in FIG. 2*a*. Wire 14*a* is provided with two contacts 61, 62 in parallel. Increasing or decreasing the pressure within the enclosed space by collapsing or extending the bellows will flex diaphragm 17*a* outwardly or inwardly respectively. In either case switch 16*a* will contact one of the two contacts of wire 14*a* completing the circuit. Conversely, loss of pressure differential will result in the diaphragm, and the switch, returning to its normal neutral position opening the circuit.

It may be noted that to increase the pressure within the enclosed space of FIG. 2, that bellows 29 is first extended before globe 22*a* is assembled onto casing 18*a*. After assembly the force of spring 30 will partially collapse the bellows decreasing the volume and increasing the pressure.

FIG. 3 represents a device for effecting a relatively large volume change where this may be desired. It comprises an outer cylinder 35 loosely surrounding a portion of an inner cylinder 36. The two cylinders are connected together by an extendible-collapsible hose 37 providing a hermetic seal therebetween. A single wire or electrical cable 60 passes through both cylinders and the hose and either terminates within the hermetic enclosure or passes through an appropriate seal. The two cylinders are caused to move relative to one another by movement of lever arm 56 pivotably attached to the outer cylinder and coacting latching bar 38 which is pivotably attached to both the inner cylinder and the lever arm. This arrangement has the characteristic that by pulling the lever arm downward it will decrease the volume of the enclosed space and by pushing the lever arm upward it will increase the enclosed space. Thus it can be used for either higher or lower pressure systems.

The embodiment of FIG. 4 has a double sealing arrangement which would be preferred for use with portable lights subject to considerable physical abuse. As in the embodiments shown in FIGS. 1 and 2 the light is held by a socket 12 which is connected to wires 14*b*, 15*b*. These wires pass through flexible conduit 26*b* and are connected to a remote switch, not shown, but which may be the same as the switch shown in FIG. 1.

The flexible conduit is sealed to casing 39 by compression nut 40 threaded onto bushing 41 which is in turn threaded into bushing 42 which screws into the casing, all threaded joints providing an air tight seal. Bushing 42 has a flange 43 which compresses and seals an edge of the cupshaped flexible bellows like member 44 to the casing. The other edge of member 44 is permanently sealed to a flange 45 of connecting ring 46. The inner surface of this connecting ring is threaded to receive globe 22*b* which is sealed thereto by gasket 47. The outer side of the connecting ring is likewise threaded to receive protective shield 48.

Two bent lever arms 49 are pivotably connected to opposite sides of the casing by lugs 50. Both lever arms are also pivotably connected to latch bars 51 which pivot in hooks 52 attached to the connecting ring.

After the globe has been threaded onto the connecting ring and sealed thereto forming the required hermetic enclosure, the lever arms are pulled downward. This draws the connecting ring down distorting the bellows like member and reducing the volume of the enclosed space. When the lever arms are fully rotated, O-ring 53 will contact the bearing surface 54 providing a second seal between the casing and the connecting ring. In the fully rotated position the ends of the lever arms will be adjacent to lugs 55 and may be attached thereto preventing any accidental opening of the lever arms and shutting off of power.

The embodiment of FIG. 5 has been designed to provide an inexpensive, reliable device requiring a minimum of maintenance. In this embodiment the casing 18*c* is provided with a shoulder 62 upon which is fitted a pliant, collapsible sealing ring or gasket 63. Globe 22*c* has a bottom edge 64 adapted to contact the sealing ring 63.

Detachably hinged from recesses 65 in the casing are a pair of opposed arms 66 which are joined together above the top of the globe where they are provided with a threaded opening. A winged threaded stud 67 is threaded through the openings and has a disc 68 on the lower end thereof.

In this construction, after the globe is placed over the lamp and has made contact with the sealing ring providing the hermetically enclosed space, the arms are placed around the globe. Tightening of the winged stud will force the globe downward compressing the sealing ring and decreasing the volume. The resultant increase in the pressure will flex diaphragm 17*c* outward and cause switch 16*c* to close providing electrical power from plug 25*c* to wires 14*c*, 15*c*.

This construction has the advantage that a very small amount of movement is required thereby extending the life of the sealing ring and damage to and wear of the sealing ring can be easily compensated for by additional tightening of the winged stud.

The embodiments described hereinabove all indicate the use of a switch for disconnecting the power whenever the integrity of the hermetically sealed enclosure is breached. In certain cases it may be desirable not to remove power but to merely indicate that a hazardous condition exists. In such cases the switch can be used to control a signal light or an audible alarm. In addition, if desired, by the use of a double throw switch the power may be cut off and an alarm sounded to indicate that the power is off.

As the use of low pressures in this invention both simplifies the sealing of the enclosure and reduces any hazards due to explosion, the volume changes should be kept as low a possible. There will normally be no need to use a volume change above 25% which would create a pressure differential of about 4.9 psi which would not always be entirely without hazard. Preferrably the volume change should be less than 10% (a pressure differential of about 1.6 psi) and most preferrably less than 5% (a pressure differential of about 12 ounces per square inch).

I claim:

1. An electrical system comprising (a) a hermetically sealed chamber, (b) an electrical circuit member within said chamber adapted to be connected to a power source, (c) means for changing the volume of said chamber after the hermetic seal has been established, thereby to create a pressure differential between the space within said chamber and the ambient atmosphere, and (d) means responsive to the loss of said pressure differential to provide a signal to said circuit member.

2. The combination of elements defined in claim 1, wherein said means for changing the volume of said chamber is operable to reduce the volume.

3. The combination of elements defined in claim 1, wherein said means for changing the volume of said chamber is operable to increase the volume.

4. The combination of elements defined in claim 1, wherein said last named means includes a diaphragm movable in response to pressure changes in said chamber, and switch means operable by movement of said diaphragm to close and open the circuit to the power source.

5. The combination of elements defined in claim 4, wherein said electrical circuit member is a lamp, and said switch means is operable to open the circuit to the power source and extinguish the lamp by movement of said diaphragm in response to the loss of said pressure differential.

6. A fluid pressure actuated electrical system comprising, (a) a casing (b) an electric lamp mounted on said casing, and adapted to be connected to a source of electrical energy, (c) a globe enclosing said lamp and secured to said casing, thereby to provide a chamber in which said lamp is located, (d) sealing means between said globe and said casing for hermetically sealing said lamp in said chamber, (e) means for changing the volume of said chamber after the hermetic seal has been established, thereby creating a pressure differential between said chamber and the ambient atmosphere, and (f) means responsive to the loss of said pressure differential to interrupt the connection between said lamp and source of electrical energy, thereby to extinguish said lamp.

7. The combination of elements defined in claim 6, wherein the means for changing the volume of said chamber includes connecting means between said globe and casing permitting relative axial movement therebetween, after the hermetic seal has been established, whereby movement of said globe and casing toward each other will reduce the volume of said chamber and increase the pressure therein.

8. The combination of elements defined in claim 6, wherein the means for changing the volume of said chamber includes a bellows in communication with said chamber, means normally maintaining said bellows in a collapsed condition, said bellows being extendible thereby to increase the effective volume in said chamber and reduce the pressure therein, and means for locking said bellows in the extended position thereof.

9. The combination of elements defined in claim 6, wherein said last named means includes a diaphragm movable in response to pressure changes in said chamber, and switch means operable by movement of said diaphragm to close and open the connection to the source of electrical energy.

* * * * *